United States Patent [19]

Fenet

[11] Patent Number: 4,773,449

[45] Date of Patent: Sep. 27, 1988

[54] DEVICE FOR MAINTAINING A LIQUID IN A SUBSTANTIALLY HORIZONTAL DUCT HAVING AN OPEN END, WHEN THE LIQUID FLOW DROPS BELOW A GIVEN THRESHOLD

[75] Inventor: Jean-Claude Fenet, Le Tholenet, France

[73] Assignee: Commissariat a l'Energie Atomique, France

[21] Appl. No.: 899,546

[22] Filed: Aug. 22, 1986

[30] Foreign Application Priority Data

Aug. 23, 1985 [FR] France ..... 85 12667

[51] Int. Cl.[4] ..... F15D 1/02

[52] U.S. Cl. ..... 138/37; 138/38

[58] Field of Search ..... 122/235 R, 235 C, 235 E, 122/235 F, 235 K; 138/26, 37, 38, 41, 42; 165/184; 181/227, 239, 268, 280; 376/204, 463

[56] References Cited

U.S. PATENT DOCUMENTS 1,672,617 8/1922 Lasker ..... 138/38 X
1,887,130 10/1926 Hobbs ..... 122/235 C

FOREIGN PATENT DOCUMENTS

DE123537 9/1901 Denmark .
BE828942 9/1975 France .
GB381889 5/1932 United Kingdom .

*Primary Examiner*—Mark J. Thronson
*Attorney, Agent, or Firm*—Michael N. Meller

[57] ABSTRACT

A device is placed in a horizontal duct, whose outlet issues into a gaseous medium, in order to retain liquid normally circulating in said duct when the flow drops below a given threshold. This device has tubes having at least one low point and at least one high point located downstream of the low point. Therefore the tubes can be helically wound around a core. At their upstream end, the tubes are fixed to a tight plate. Holes made in the tubes at the location of the high points prevent any siphon effect. Thus, liquid plugs form in the tubes when the flow is low or zero.

5 Claims, 2 Drawing Sheets

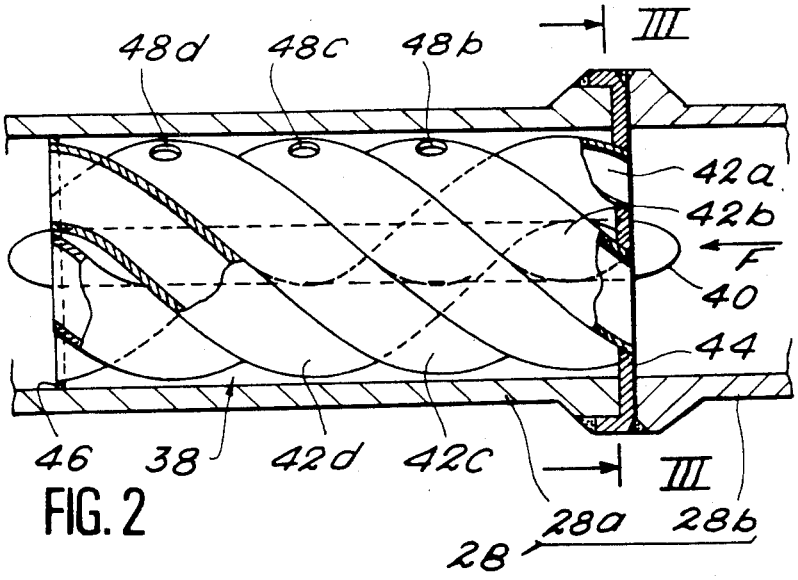
FIG. 2
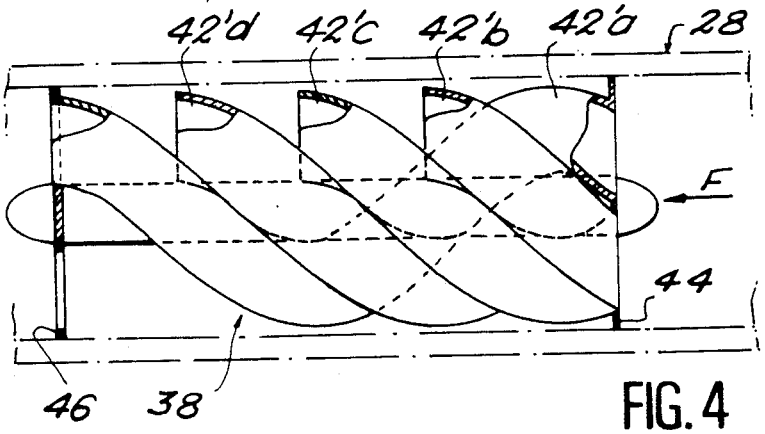
FIG. 4
FIG. 3
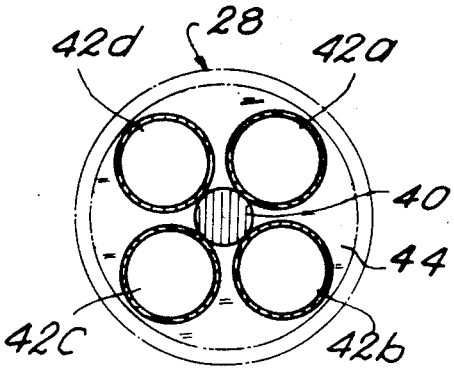

DEVICE FOR MAINTAINING A LIQUID IN A SUBSTANTIALLY HORIZONTAL DUCT HAVING AN OPEN END, WHEN THE LIQUID FLOW DROPS BELOW A GIVEN THRESHOLD

BACKGROUND OF THE INVENTION

The present invention relates to a device making it possible to maintain a liquid in a substantially horizontally axed duct and having an open outlet end, when the outflow of said liquid is stopped or when its flow drops below a given threshold.

In a substantially horizontal duct, whose outlet end issues into a gaseous medium such as water vapor or steam, or significant drop in the flow has the effect of gas entering the pipe system. When the flow of liquid in the pipe system rises to its normal operating level, the gas present therein leads to water hammer.

Moreover, the temperature of the liquid circulating in the duct may suddenly drop and this phenomenon is accompanied by a drop in the flow. As a result of the density effects between the cold liquid and the hot liquid, a stratification of said liquid then occurs and advances along the pipe system, so that severe thermal stresses can be produced in this way.

Situations of this type can occur in pressurized water nuclear reactors, equipped with steam generators of a particular type. Thus, in certain steam generators, like that described in FR-A-No. 2 428 787, the feed water of the water - steam circuit of the reactor is admitted into the generator by a horizontal duct issuing into a toroidal collector having orifices along its lower generatrix. This collector is placed in the steam atmosphere prevailing in the upper part of the generator, so that water hammer can occur as a result of the steam entering the horizontal duct when there is a significant drop in the flow in the water - steam circuit.

Moreover, under certain operating conditions, the temperature of the feed water injected into the steam generator can be reduced and so can the flow. It is then possible for the aforementioned stratification phenomenon to occur, leading to severe thermal stresses on the connecting pipe between the envelope of the generator and the feed water intake duct.

SUMMARY OF THE INVENTION

The invention relates to a device making it possible to solve these problems, whilst ensuring at a low flow rate that liquid is maintained in a substantially horizontally axed open duct, without excessively disturbing the outflow of liquid in said duct under normal operating conditions.

The present invention therefore specifically relates to a device for maintaining a liquid in a substantially horizontally axed duct having an outlet end issuing into a gaseous medium, when the flow of said liquid is below a given threshold, wherein the device comprises four tubes placed in the duct and wound helically about a central core arranged along the duct axis, each of these tubes having at least one low point for which the tube is totally positioned below the duct axis and a high point for which the tube is completely above said axis and has an opening communicating with the outlet end of the duct, the high point being closer to the outlet end than the low point, a tight support plate being positioned between the duct and said tube at one end of the latter opposite to said duct outlet end.

In such a device, the tubes remain permanently filled with water on the side of their intake end. Moreover, each of the tubes has an opening in its highest point, so that no siphon effect occurs. Therefore the circulation of liquid in each tube is solely determined by the flow in the duct. When the flow is eliminated or becomes very limited, stagnant liquid remains in each tube and to some extent forms a plug opposing the outflow of the liquid contained therein. Thus, the sought effect is obtained. Conversely the device is designed so as to minimally disturb the outflow of liquid under normal operating conditions, i.e. when the flow is high. Moreover, the use of four helically wound tubes makes it possible to reduce to a minimum the passage cross section. In order to even further reduce the resistance to the outflow, the ends of the central core are preferably streamlined.

In a first constructional variant according to the invention, the opening is a hole formed in the highest part of the tube wall.

In a second constructional variant according to the invention, the other end of the tube is located at said high point and forms said opening.

BRIEF DESCRIPTION OF THE DRAWINGS

The invention will be described in greater detail hereinafter relative to non-limitative embodiments and the attached drawings, wherein FIG. 1 diagrammatically shows a steam generator whose feed water intake duct is equipped with a device according to the invention.

FIG. 2 is a part longitudinal sectional view on a larger scale of the liquid retaining device equipping the duct shown in FIG. 1.

FIG. 3 is a sectional view along line III—III of FIG. 2.

FIG. 4 is a view comparable to FIG. 2 showing a constructional variant of the device according to the invention.

DETAILED DESCRIPTION OF THE PREFERRED EMBODIMENTS

Figure 1:
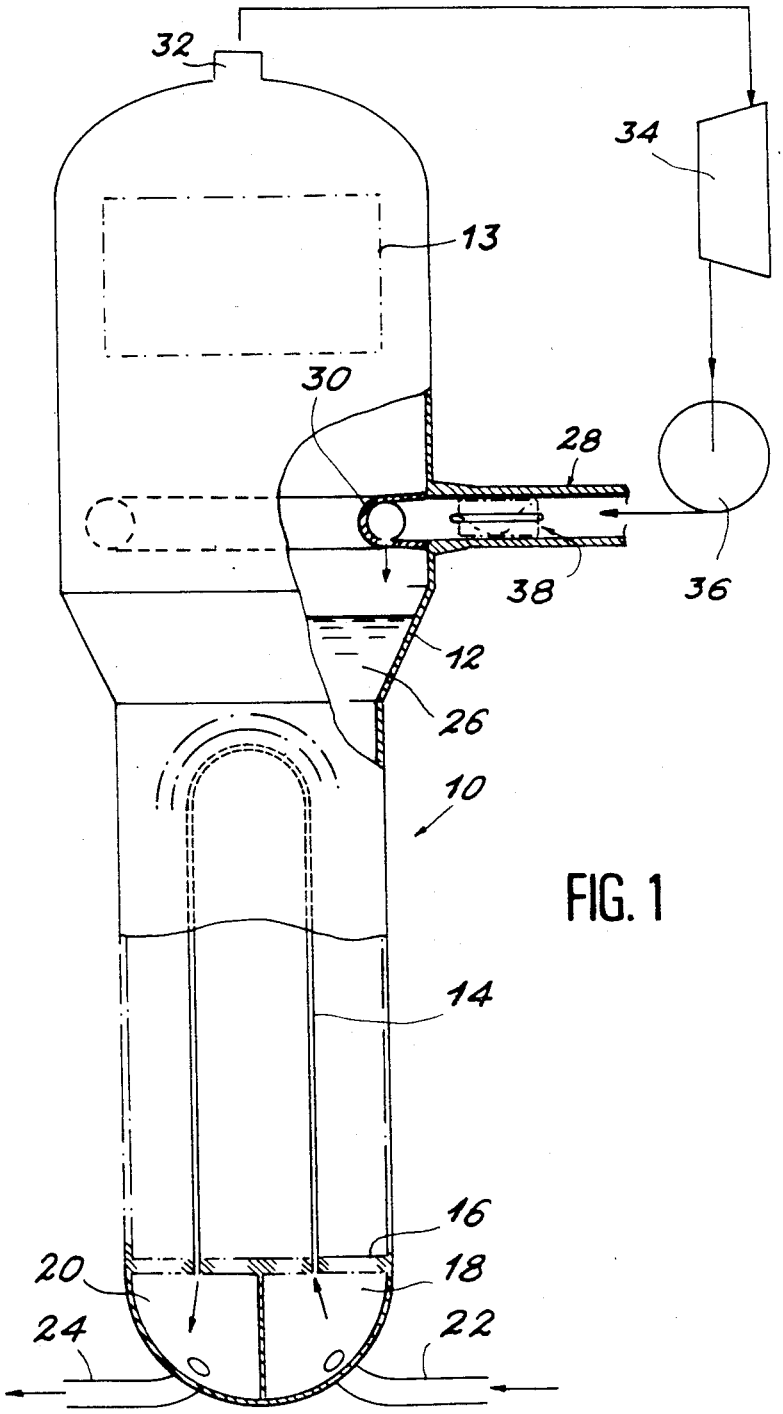

FIG. 1 very diagrammatically shows a steam generator ensuring a heat exchange between the primary water circuit and the secondary water - steam circuit in a pressurized water nuclear reactor. Steam generator 10 shown in FIG. 1 is of the same type as that described in FR-A-No. 2 428 787, so that no detailed description will be provided here.

Generator 10 comprises a vertically axed cylindrical envelope 12, in the lower part of which is arranged a bundle of inverted U-shaped tubes 14. The ends of tubes 14 are fixed to a horizontal tube plate 16 defining with the lower hemispherical end of envelope 12 a primary water intake chamber 18 and a primary water discharge chamber 20. Pipes 22 and 24 respectively communicate with chambers 18 and 20 and make it possible to connect these to the remainder of the primary circuit.

The secondary circuit water 26, in which are immersed the tubes 14 of the bundle, is introduced into the upper part of envelope 12 by a substantially horizontally duct 28. This duct 28 issues into a feed torus 30 having perforated holes along its lower generatrix. This torus 30 is placed in the steam formed by heating the secondary circuit water 26 resulting from the circulation of the primary water within the U-shaped tubes 14. The thus formed steam is discharged through a dome formed at the upper end of envelope 12 by a discharge pipe 32, after traversing draining or drying devices 13.

The secondary circuit also has in per se known manner a turbine 34 and a circulating pump 36.

In such a configuration, the horizontal duct 28 which issues via torus 30 into the steam atmosphere prevailing in the upper part of envelope 12 suffers from the aforementioned disadvantages. Thus, a stoppage or significant drop in the water flow admitted by the horizontal duct 28 into the steam generator leads to steam penetrating torus 30 and horizontal duct 28. Moreover, in certain operating configurations, a smaller cold water flow than hitherto may be passed into the steam generator. Bearing in mind the density effects between the cold water and the hot water, a stratification then tends to occur and to advance along the pipe system. This stratification then produces severe thermal stresses, particularly on the connecting pipe between the steam generator envelope 12 and the pipe system 28.

In order to obviate these disadvantages, it is proposed by the present invention to place a liquid retaining device 38 in duct 28 in the vicinity of the open end of the latter.

This device, which is shown in greater detail in FIGS. 2 and 3, comprises a central hub 40, with a relatively slight cylindrical cross section and which is arranged along the axis of duct 28. In order to reduce the outflow resistance of the liquid (arrow F in FIG. 2) of said central hub 40, its ends are streamlined.

Four helically wound tubes 42*a*, 42*b*, 42*c* and 42*d* with a circular cross section are placed in the annular space formed between the central hub 40 and duct 28. Hub 40 and the ends of tubes 42*a* to 42*d* opposite to the open outlet end of duct 28, i.e. the right-hand ends in FIG. 2 are welded to a tight support plate 44. The latter supports the tubes and the core within duct 28, whilst making the liquid circulating in the duct pass through the interior of tubes 42*a* to 42*d*.

The ends of tubes 42*a* to 42*d* closest to the open outlet end of duct 28, as well as the corresponding end of the central core 40, are supported by a second plate 46 preferably coated with a certain clearance within duct 28. Unlike plate 44, plate 46 is not tightly sealed. The passage of fluid on either side of said plate can take place via the annular space formed between the periphery thereof and duct 28 and/or by perforations passing through it.

As is more particularly illustrated by FIG. 3, tubes 42 have an external diameter which is only very slightly less than the difference between the internal radius of duct 28 and the external radius of core 40. Thus, the passage cross section of device 38 is as large as possible, so that there is a minimum resistance to the outflow within duct 28.

In the constructional variant shown in FIG. 2, tubes 42a to 42d are all of the same length, which is such that each of them extends over at least one pitch of the helix formed by it around core 40. Thus, each of the tubes 42 passes through at least one high point where it is completely above the axis of duct 28 and at least one low point at which it is completely below said axis, said low point being located upstream of the high point, in the case of the liquid outflow direction indicated by arrow F.

As illustrated by FIG. 2, the high point of tube 42*a* positioned downstream of its low point coincides with the end of said tube fixed to plate 46. It therefore communicates directly with the open outlet end of duct 28, so that no siphon effect is possible.

However, the high points of tubes 42*b*, 42*c* and 42*d* are followed downstream by a downward tube portion, so that there is a risk of a siphon effect. In order to eliminate this risk, a hole 48*b*, 48*c* and 48*d* is formed in the highest part of the wall of each of the tubes at the location of said high point.

FIG. 2 also shows the special case where duct 28 is formed from two portions designated 28*a* and 28*b* in the drawing. This configuration facilitates the mounting and fixing of device 38 within the pipe system. Thus, the facing ends of duct portions 28*a* 28*b* are provided with flanges between which plate 44 can be fixed, more particularly by welding.

The operation of the above device will now be described with reference to FIGS. 2 and 3. Under normal operating conditions, i.e. when a liquid flows out in the direction of arrow F with a relatively high flow rate, the pressure drop introduced into the duct by said device is sufficiently small for the outflow of liquid not to be significantly disturbed.

When the flow stops or drops below a given minimum threshold, the gaseous medium (in this case steam) into which issues the left-hand end of the duct in FIG. 2 penetrates via said end into the duct. As the device 38 is installed in the vicinity of said open end, the steam rapidly reaches said device, at least in the upper portion of the duct. As a result of the non-tight nature of plate 46, the steam penetrates the high point of each of the tubes by holes 48*b* to 48*d* for tubes 42*b* to 42*d* and by the open left-hand end of tube 48*a*. This introduction of steam into the high point of each of the tubes has the effect of preventing any siphoning phenomenon of the liquid present upstream of device 38 towards the open end of duct 28.

Each of the high points of tubes 42*a* to 42*d* filled with steam in this way is preceded towards the upstream side by a low point of said same tube, so that a liquid plug is formed in each of the tubes. Thus, the sought effect is obtained in a simple manner, without significantly disturbing the liquid flow under normal operating conditions.

The constructional variant shown in FIG. 4 essentially differs from the variant described with reference to FIGS. 2 and 3 by the fact that the admission of gaseous fluid by the high points of each of the tubes 42'*b* to 42'*d* is no longer realized by means of a hole, but by using tubes of different lengths, whose end which is closest to the open outlet end of duct 28 (i.e. the left-hand end in FIG. 4) is located at said high point. The left-hand ends of each of the tubes 42'*a* to 42'*d* are consequently regularly spaced between plates 46 and 44. Therefore, only tube 48'*a* is fixed to plate 46.

The operation of the device shown in FIG. 4 is otherwise completely identical to that of the device described hereinbefore with reference to FIGS. 2 and 3.

FIG. 4 also shows as a variant the case where device 38 is installed within a one-piece duct 28, the periphery of plate 44 then being directly welded to the interior of said duct.

Obviously, the invention is not limited to the embodiments described in exemplified manner hereinbefore and in fact covers all variants thereof.

Thus, the tubes with a circular cross section described can be replaced by any other type of tube, i.e. by tubes having different cross sections, as well as tubes defined by radial partitions (e.g. four) helically wound around the central core. The partitions can then be welded to a ferrule arranged with a small clearance within the duct and provided in its upper part with holes at the location of the high point of each tube and whereof the upstream end is tightly fixed in the duct by an annular support plate. The partitions can also be directly welded within the duct. In this case, the opening of each tube at the location of the high point is obtained, as in FIG. 4, by interrupting the tube at this location. The latter solution makes it possible to reduce to the maximum extent possible the disturbances of the outflow of liquid under normal operating conditions.

Finally, even if such a device has particularly advantageous applications in the case of a secondary water supply duct for a steam generator, like that of FIG. 1, this application is in no way limitative. In particular, such a device can be used in all hydraulic circuits having a substantially horizontal duct, one end of which issues into a gaseous fluid, in order to prevent water hammer or thermal problems in such a duct.

What is claimed is:

1. A substantially horizontally axed duct, said duct having an outlet end issuing into a gaseous medium, and a device incorporated in said duct for maintaining a liquid in said duct when the flow of said liquid is below a given threshold, said device comprising a central core arranged along the duct axis, and a plurality of tubes placed in said duct and wound helically about said core, each of said tubes comprising a low point at which said tube is positioned entirely below said axis, a high point at which said tube is positioned entirely above said axis, and an opening at said high point, said opening being in communication with said outlet end, said high point being closer to said outlet end than said low point is, said device further comprising a tight support plate, said plate being secured to said duct, each of said tubes being connected to said plate at a first end opposite to said outlet end in a fluid tight manner.

2. The invention of claim 1, wherein said core has ends which are streamlined.

3. The invention of claim 1, wherein the opening of one of said tubes is a hole formed in the highest part of the wall of said tube.

4. The invention of claim 1, wherein at least one of said tubes has a second end opposite to said first end, said second end being said high point of said tube and forming said opening of said tube.

5. A substantially horizontally axed duct, said duct having an outlet end issuing into a gaseous medium, and a device incorporated in said duct for maintaining a liquid in said duct when the flow of said liquid is below a given threshold, said device comprising a central core arranged along the duct axis, and a plurality of tubes placed in said duct and wound helically about said core, each of said tubes comprising a low point at which said tube is positioned entirely below said axis, a high point at which said tube is positioned entirely above said axis, and an opening at said high point, said opening being in communication with said outlet end, said high point being closer to said outlet end than said low point is, said device further comprising a support plate, said plate having a plurality of holes, said plate being secured inside said duct, each of said tubes being connected to said plate and communicating with said duct on an upstream side of said plate by way of a corresponding one of said holes, whereby said plate is arranged to block flow from said upstream side of said plate to the downstream side of said plate by any path other than through said tubes.

* * * * *